US009719196B2

(12) United States Patent
Salama et al.

(10) Patent No.: US 9,719,196 B2
(45) Date of Patent: Aug. 1, 2017

(54) INTERLOCKING WEAVE FOR HIGH PERFORMANCE FABRICS

(71) Applicants: Mahmoud M Salama, Anderson, SC (US); Keith K Bendyk, Duncan, SC (US)

(72) Inventors: Mahmoud M Salama, Anderson, SC (US); Keith K Bendyk, Duncan, SC (US)

( * ) Notice: Subject to any disclaimer, the term of this patent is extended or adjusted under 35 U.S.C. 154(b) by 63 days.

(21) Appl. No.: 14/797,881

(22) Filed: Jul. 13, 2015

(65) Prior Publication Data

US 2016/0298271 A1 Oct. 13, 2016

Related U.S. Application Data

(60) Provisional application No. 62/143,856, filed on Apr. 7, 2015.

(51) Int. Cl.

| | |
|---|---|
| ***D03D 13/00*** | (2006.01) |
| ***D03D 1/00*** | (2006.01) |
| *D03D 25/00* | (2006.01) |

(52) U.S. Cl.

CPC ..... *D03D 1/0052* (2013.01); *D03D 13/004* (2013.01); *D10B 2401/063* (2013.01); *D10B 2505/02* (2013.01)

(58) Field of Classification Search

CPC .... D03D 1/0052; D03D 13/004; D03D 13/00; D03D 13/008; D03D 15/00; D03D 25/005; D03D 41/004; D03D 15/12; D03D 23/00; F41H 5/0485; F41H 1/02

See application file for complete search history.

(56) References Cited

U.S. PATENT DOCUMENTS

| | | | | |
|---|---|---|---|---|
| 3,252,484 A * | 5/1966 | Meyer | D02G 3/40 | 139/426 R |
| 3,965,943 A * | 6/1976 | Goff, Jr. | A41F 9/02 | 139/421 |
| 5,187,003 A * | 2/1993 | Chitrangad | D03D 1/0052 | 139/420 A |
| 5,429,686 A * | 7/1995 | Chiu | D03D 23/00 | 139/383 A |

(Continued)

FOREIGN PATENT DOCUMENTS

EP 2458048 A2 5/2012

*Primary Examiner* — Bobby Muromoto, Jr.

(74) *Attorney, Agent, or Firm* — Southeast IP Group, LLC.; Thomas L. Moses

(57) ABSTRACT

A weave pattern and method for weaving that provides stability to high performance fabrics, such as fabrics used for life protection and composite use, is provided. An additional set of yarn may be added in the warp direction, such that there are two sets of warp yarns per fill yarn alternating throughout the structure of the fabric. This second set of warp yarn locks the fill yarns in place, subsequently interlocking and stabilizing the fabric pattern. This stabilization increases tensile strength, tightness, stiffness, and also improves the handling and cutting of the fabric by resulting in decreased fraying and fiber loss during product construction. Also, the fabric maintains proper shape and form due to the 90 degree interlacing of warp and fill yarns. In this way, the fabric may have the enhanced performance characteristics of a looser weave in combination with the enhanced handleability of a tighter weave.

20 Claims, 7 Drawing Sheets

(56) References Cited

U.S. PATENT DOCUMENTS

| | | | | |
|---|---|---|---|---|
| 6,000,442 | A * | 12/1999 | Busgen | D03D 3/08 139/100 |
| 6,315,007 | B1 * | 11/2001 | Mohamed | D03D 25/005 139/11 |
| 6,475,936 | B1 * | 11/2002 | Chiou | A41D 31/0061 2/2.5 |
| 6,854,488 | B2 * | 2/2005 | Hay | D21F 1/0036 139/383 A |
| 7,270,152 | B2 * | 9/2007 | Ueda | D21F 1/0036 139/383 A |
| 8,141,595 | B2 * | 3/2012 | Quigley | D21F 1/0045 139/383 A |
| 8,293,665 | B2 * | 10/2012 | Hartert | D03D 1/0052 442/203 |
| 2002/0098759 | A1 * | 7/2002 | Salway | D03D 9/00 442/200 |
| 2008/0081528 | A1 * | 4/2008 | Carter | D02G 3/16 442/190 |
| 2010/0124862 | A1 * | 5/2010 | Smith | D03D 1/0052 442/181 |
| 2011/0183562 | A1 * | 7/2011 | Carter | D02G 3/16 442/187 |
| 2012/0235433 | A1 * | 9/2012 | Powers | B66C 1/18 294/77 |
| 2014/0206248 | A1 * | 7/2014 | Vito | B32B 5/022 442/2 |

* cited by examiner

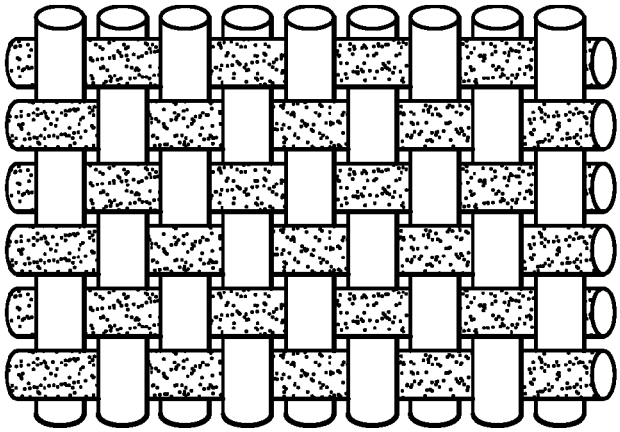
FIG. -1A-
PLAIN
| | | | | | |
|---|---|---|---|---|---|
| | X | | | X | X |
| X | | X | X | | |
| | X | | | X | X |
| X | | X | X | | |
| 1 | 2 | 3 | 4 | 5 | 6 |
| SET 1 | SET 1 | SET 2 | SET 1 | SET 1 | SET 2 |
FIG. -1B-
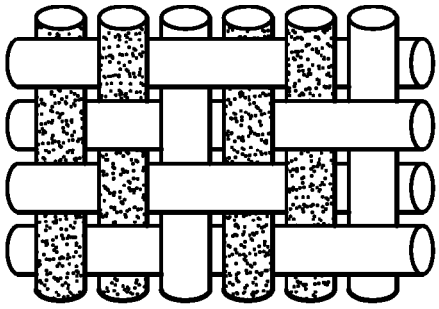
S1 S1 S2 S1 S1 S2
FIG. -1C-

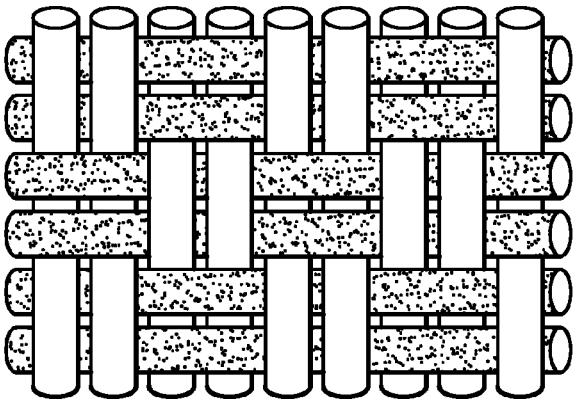
FIG. -2A-
2/2 BASKET
| | | | | | |
|---|---|---|---|---|---|
| | | | X | X | X |
| | | X | X | X | |
| X | X | | | | X |
| X | X | X | | | |
| 1 SET 1 | 2 SET 1 | 3 SET 2 | 4 SET 1 | 5 SET 1 | 6 SET 2 |
FIG. -2B-
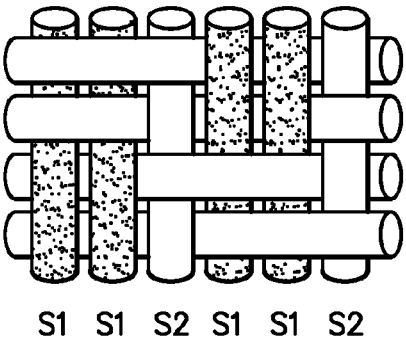
FIG. -2C-

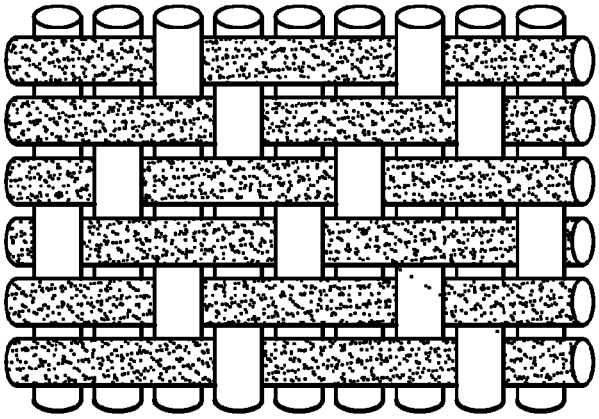
FIG. -3A-
4HS (CF)
| | | | | | |
|---|---|---|---|---|---|
| | | | X | | X |
| | | X | | X | |
| | X | | | | X |
| X | | X | | | |
| 1 | 2 | 3 | 4 | 5 | 6 |
| SET 1 | SET 1 | SET 2 | SET 1 | SET 1 | SET 2 |
FIG. -3B-
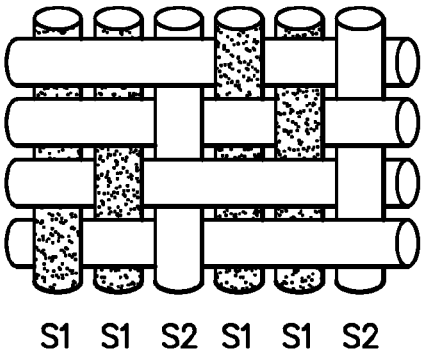
FIG. -3C-

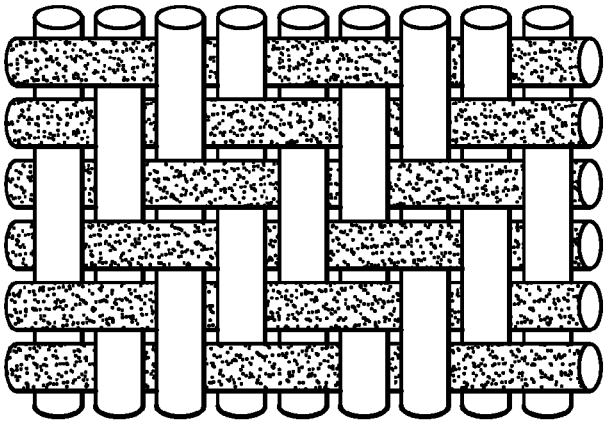
FIG. -4A-
2/2 TWILL
| | | | | | |
|---|---|---|---|---|---|
| | | | X | X | X |
| | X | X | X | | |
| X | X | | | | X |
| X | | X | | X | |
| 1 SET 1 | 2 SET 1 | 3 SET 2 | 4 SET 1 | 5 SET 1 | 6 SET 2 |
FIG. -4B-
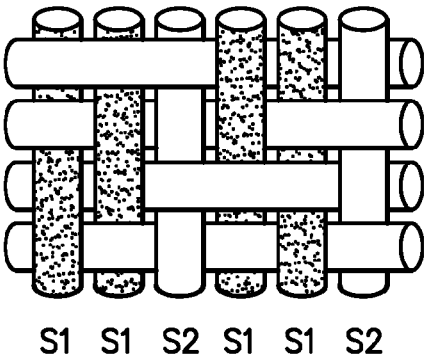
FIG. -4C-

| SET 1:SET 2 | oz/yd2 | FABRIC A | PATTERN | WARP DENIER | TEX | ENDS/INCH |
|---|---|---|---|---|---|---|
| | 3.68 | WARP SET 1 | PLAIN | 500 | 55.56 | 28.00 |
| | 3.68 | WARP SET 1 | 2/2 TWILL | 500 | 55.56 | 28.00 |
| | 3.68 | WARP SET 1 | 2/2 BASKET | 500 | 55.56 | 28.00 |
| | 3.68 | WARP SET 1 | 4 H | 500 | 55.56 | 28.00 |
| | | | | | | |
| 2:1 | 0.37 | WARP SET 2 | PLAIN | 200 | 22.22 | 14.00 |
| 3:1 | 0.25 | WARP SET 2 | PLAIN | 200 | 22.22 | 9.33 |
| 4:1 | 0.18 | WARP SET 2 | PLAIN | 200 | 22.22 | 7.00 |
| | | | | | | |
| 2:1 | 0.37 | WARP SET 2 | 2/2 TWILL | 200 | 22.22 | 14.00 |
| 3:1 | 0.25 | WARP SET 2 | 2/2 TWILL | 200 | 22.22 | 9.33 |
| 4:1 | 0.18 | WARP SET 2 | 2/2 TWILL | 200 | 22.22 | 7.00 |
| SET 1: SET 2 | oz/yd2 | FABRIC B | PATTERN | WARP DENIER | TEX | ENDS/INCH |
| | 4.27 | WARP SET 1 | PLAIN | 840 | 93.33 | 19.50 |
| | 4.27 | WARP SET 1 | 2/2 TWILL | 840 | 93.33 | 19.50 |
| | 4.27 | WARP SET 1 | 2/2 BASKET | 840 | 93.33 | 19.50 |
| | 4.27 | WARP SET 1 | 4H | 840 | 93.33 | 19.50 |
| | | | | | | |
| 2:1 | 0.26 | WARP SET 2 | PLAIN | 200 | 22.22 | 9.75 |
| 3:1 | 0.17 | WARP SET 2 | PLAIN | 200 | 22.22 | 6.50 |
| 4:1 | 0.13 | WARP SET 2 | PLAIN | 200 | 22.22 | 4.88 |
| | | | | | | |
| 2:1 | 0.26 | WARP SET 2 | 2/2 TWILL | 200 | 22.22 | 9.75 |
| 3:1 | 0.17 | WARP SET 2 | 2/2 TWILL | 200 | 22.22 | 6.50 |
| 4:1 | 0.13 | WARP SET 2 | 2/2 TWILL | 200 | 22.22 | 4.88 |

*FIG. –5A–*

| PATTERN (FABRIC A) | SET 1:SET 2 | Kw | FILL DENIER | FILL TEX | FILL/INCH | Kf | FABRIC COVER FACTOR | TIGHTENESS FACTOR |
|---|---|---|---|---|---|---|---|---|
| PLAIN | | 0.32 | 500 | 55.56 | 28.00 | 0.32 | 0.54 | 0.72 |
| 2/2 TWILL | | 0.32 | 500 | 55.56 | 28.00 | 0.32 | 0.54 | 0.61 |
| 2/2 BASKET | | 0.32 | 500 | 55.56 | 28.00 | 0.32 | 0.54 | 0.61 |
| 4 H | | 0.32 | 500 | 55.56 | 28.00 | 0.32 | 0.54 | 0.61 |
| | | | | | | | | |
| PLAIN | 2:1 | 0.10 | 500 | 55.56 | 28.00 | 0.32 | 0.39 | 0.52 |
| PLAIN | 3:1 | 0.07 | 500 | 55.56 | 28.00 | 0.32 | 0.37 | 0.49 |
| PLAIN | 4:1 | 0.05 | 500 | 55.56 | 28.00 | 0.32 | 0.36 | 0.48 |
| | | | | | | | | |
| 2/2 TWILL | 2:1 | 0.10 | 500 | 55.56 | 28.00 | 0.32 | 0.39 | 0.44 |
| 2/2 TWILL | 3:1 | 0.07 | 500 | 55.56 | 28.00 | 0.32 | 0.37 | 0.42 |
| 2/2 TWILL | 4:1 | 0.05 | 500 | 55.56 | 28.00 | 0.32 | 0.36 | 0.40 |
| PATTERN (FABRIC B) | SET 1: SET 2 | Kw | FILL DENIER | FILL TEX | FILL/INCH | Kf | FABRIC COVER FACTOR | TIGHTENESS FACTOR |
| PLAIN | | 0.29 | 840 | 93.33 | 19.50 | 0.29 | 0.50 | 0.66 |
| 2/2 TWILL | | 0.29 | 840 | 93.33 | 19.50 | 0.29 | 0.50 | 0.56 |
| 2/2 BASKET | | 0.29 | 840 | 93.33 | 19.50 | 0.29 | 0.50 | 0.56 |
| 4H | | 0.29 | 840 | 93.33 | 19.50 | 0.29 | 0.50 | 0.56 |
| | | | | | | | | |
| PLAIN | 2:1 | 0.07 | 840 | 93.33 | 19.50 | 0.29 | 0.34 | 0.46 |
| PLAIN | 3:1 | 0.05 | 840 | 93.33 | 19.50 | 0.29 | 0.33 | 0.43 |
| PLAIN | 4:1 | 0.04 | 840 | 93.33 | 19.50 | 0.29 | 0.32 | 0.42 |
| | | | | | | | | |
| 2/2 TWILL | 2:1 | 0.07 | 840 | 93.33 | 19.50 | 0.29 | 0.34 | 0.39 |
| 2/2 TWILL | 3:1 | 0.05 | 840 | 93.33 | 19.50 | 0.29 | 0.33 | 0.37 |
| 2/2 TWILL | 4:1 | 0.04 | 840 | 93.33 | 19.50 | 0.29 | 0.32 | 0.36 |

*FIG. -5B-*

| FABRIC | SET RATIO | SET 1 WEAVE | SET 2 WEAVE | FABRIC TENSILE STRENGTH,lb | | FABRIC STIFFNESS, inch | | FABRIC KING STIFFNESS, lb |
|---|---|---|---|---|---|---|---|---|
| | | | | WARP DIRECTION | FILL DIRECTIION | WARP DIRECTION | FILL DIRECTIION | |
| A | 2:1 | PLAIN | PLAIN | 697 | 622 | 4.58 | 4.18 | 1.23 |
| | | 2/2 TWILL | PLAIN | 772 | 627 | 4.05 | 4.15 | 0.82 |
| | | 2/2 BASKET | PLAIN | 775 | 635 | 4.55 | 3.78 | 0.611 |
| | | 4H SATIN | PLAIN | 752 | 642 | 4.40 | 3.95 | 0.948 |
| | | | | | | | | |
| | | | | | | | | |
| B | 2:1 | PLAIN | PLAIN | 715 | 694 | 4.70 | 4.32 | 1.15 |
| | | 2/2 TWILL | PLAIN | 761 | 687 | 4.18 | 4.28 | 0.626 |
| | | 2/2 BASKET | PLAIN | 760 | 703 | 4.40 | 4.03 | 0.54 |
| | | 4H SATIN | PLAIN | 806 | 714 | 4.13 | 4.75 | 0.775 |
| | | | | | | | | |

*FIG. -6-*

INTERLOCKING WEAVE FOR HIGH PERFORMANCE FABRICS

BACKGROUND OF THE INVENTION

Fabrics made from high performance polymer fibers may utilized in a variety of commercial and private end-uses ranging from composites and aircraft to body armor and armored vehicles. Performance textiles are also used across the market to provide fabrics and designs that can withstand heat, abrasions, stains, discolorations, and other environmental assaults. Antiballistic articles or fabrics woven for life protection are used to repel and trap ammunition, shrapnel, or hand driven sharp objects such as knives, awls, shanks and the like. These antiballistic fabrics are typically layered, cut, and stitched in a pattern to construct protective soft armor such as vests, or may be used in the construction of armored vehicles and helmets.

High performance fabrics may be woven in patterns such as plains, twills, baskets, and satins. The warp and fill yarn interlace at right angles, are typically light weight, and preferably have floats extending over multiple yarns. Patterns such as twill and satins have shown improved ballistic performance due in part to the longer floats of a looser weave. For instance, when a projectile hits a protective vest or other article of protective material, the resulting back face deformation is typically reduced in a looser weave than when compared to a plain weave. The main goal of protective armor is to prevent fatalities and minimize damage, injury and blunt force trauma to the person(s) being protected; therefore, it is most desirable utilize a fabric that results in less back face deformation. However, using these type of weaves represents a challenge to armor manufacturers during layering and cutting patterns due to looseness of the fabric structure, fraying, and distortion that causes yarn interlacing to deviate from right angle interlacing. The yarns of these fabrics are not secured as well within the fabric layer and therefore tend to fray and fall apart along the cut edges more easily. For these reasons, these weaving patterns are not widely used in the high performance fabric industry. Although the performance characteristics of the fabric may be enhanced by these particular weaves, the difficulty in handling poses a large problem.

When using a tighter weave, such as a plain weave, the handleablility during fabric construction may be improved over that of a looser weave; however, the performance characteristics may not be up to par for a particular end-use. Furthermore, high performance fabrics constructed from a plain weave or a tight construction may not conform as easily to a particular shape or curvature. When designing vests or other clothing, this characteristic translates to clothing that does not conform as well to a person's body and tends to be very uncomfortable to wear. When military personnel and law enforcement wear antiballistic clothing, maintaining maneuverability is essential; these articles should provide protection, not distraction. Therefore, it would be beneficial to design a high performance fabric of a lower weight and improved comfort that can bend and conform more easily to accommodate both men and women of varying body types and sizes, as well as maintaining the high quality performance characteristics required of these articles.

Given the problems and disadvantages associated with the current art, it would be advantageous to provide a weaving pattern and process that results in a fabric having the handleablility of a tighter weave with the performance characteristics of a looser weave. This fabric would maintain shape and construction during the manufacturing of an end-use product, yet still possess the advantages resulting from the longer float of a looser weave. A further advantage would be improved tightness and stabilization of the fabric, particularly when the fabric is cut and sewn together to form a desired system, yet the fabric may still conform easily to a variety of shapes and curvatures. The weave pattern and process of the present invention provides stability of fabric structure without compromising the quality and performance characteristics of the end-use product.

BRIEF SUMMARY OF THE INVENTION

The present invention consists of a weave pattern and method that provides stability to high performance fabrics, such as fabrics used for life protection (i.e. antiballistic) and composite use. This weave pattern and method is not restricted to high performance fabrics, however, and may be applied to the construction of any type of fabric where improved handleablilty is desired. This invention consists of adding an additional set of yarn in the warp direction, such that there are two sets of warp yarns per fill yarn alternating throughout the structure of the fabric. Set one may consist of any known weave pattern such as plain, twill, basket, satin, or another pattern. Set two is preferably a plain weave in the warp direction, alternating over and under each fill yarn, but may be any weave variation provided it is inserted in the fabric such that it interrupts the pattern of set one.

This introduction of a second set of warp yarn locks the fill yarns in place, subsequently interlocking and stabilizing the fabric pattern. This stabilization increases tensile strength, tightness, stiffness, and also improves the handling and cutting of the fabric by resulting in decreased fraying and fiber loss during product construction. Also, the fabric maintains proper shape and form due to the 90 degree interlacing of warp and fill yarns. This interlacing is maintained and does not suffer from the distortion that may be found in looser weaves with a longer float. In this way, the fabric may have the enhanced performance characteristics of a looser weave in combination with the enhanced handleability of a tighter weave.

DESCRIPTION OF THE DRAWINGS

These and other features, aspects, and advantages of the present invention will become better understood with regard to the following description, appended claims, and accompanying drawings where:

FIG. 1A illustrates a traditional plain weave with a single set of warp yarn.

FIG. 1B illustrates a weave chart showing one embodiment of the present invention, whereby a plain weave set one warp yarn is interrupted with an alternating plain weave set two warp yarn.

FIG. 1C illustrates a plain weave of one embodiment of the present invention whereby a plain weave set one warp yarn is interrupted with an alternating plain weave set two warp yarn.

FIG. 2A illustrates a traditional 2/2 basket weave with a single set of warp yarn.

FIG. 2B illustrates a weave chart showing one embodiment of the present invention, whereby a 2/2 basket weave set one warp yarn is interrupted with an alternating plain weave set two warp yarn.

FIG. 2C illustrates a 2/2 basket weave of one embodiment of the present invention, whereby a 2/2 basket weave set one warp yarn is interrupted with an alternating plain weave set two warp yarn.

FIG. 3A illustrates a traditional four harness satin weave with a single set of warp yarn.

FIG. 3B illustrates a weave chart showing one embodiment of the present invention, whereby a four harness satin weave set one warp yarn is interrupted with an alternating plain weave set two warp yarn.

FIG. 3C illustrates a four harness satin weave of one embodiment of the present invention, whereby a four harness satin weave set one warp yarn is interrupted with an alternating plain weave set two warp yarn.

FIG. 4A illustrates a traditional 2/2 twill weave with a single set warp yarn.

FIG. 4B illustrates a weave chart showing one embodiment of the present invention, whereby a 2/2 twill weave set one warp yarn is interrupted with an alternating plain weave set two warp yarn.

FIG. 4C illustrates a 2/2 twill weave of one embodiment of the present invention, whereby a 2/2 twill weave set one warp yarn is interrupted with an alternating plain weave set two warp yarn.

FIG. 5A is a chart showing the pattern, warp denier, tex, and ends per inch used to calculate fabric cover factor and calculate tightness factor of fabrics with and without warp set two.

FIG. 5B is a continuation of the chart of FIG. 5*a* chart showing the calculated fabric cover factor and calculated tightness factor of fabrics with and without warp set two, as well as the values used to calculate each factor.

FIG. 6 is a chart showing experimental values of fabric tensile strength and fabric stiffness of fabric with warp set two.

DETAILED DESCRIPTION OF THE INVENTION

FIGS. 1A, 2A, 3A, and 4A represent traditional weave patterns with a single set of warp yarn. FIGS. 1B, 2B, 3B, and 4B are weave charts representing these same weave patterns interrupted and interlocked with a second set of warp yarn in a plain weave pattern. Columns 1-6 of these "B" group figures represent a warp yarn, while each row represents a fill yarn. The "X" denotes where the warp yarn is passing over the fill yarn. FIGS. 1C, 2C, 3C, and 4C represent weave patterns of the present invention derived from the weave charts of FIGS. 1B, 2B, 3B, and 4B.

The ratio range of warp set one to warp set two is preferably 2:1 to 5:1, more preferably 2:1 to 3:1, most preferably 2:1. For example: in a 2:1 ratio, there would be two yarns of warp set one, followed by one yarn of warp set two, followed by two yarns of warp set one, followed by one yarn of warp set two, and so on. In a 3:1 ratio, there would be three yarns of warp set one, followed by one yarn of warp set two, followed by three yarns of warp set one, followed by one yarn of warp set two, and so on. If a ratio below 2:1 is used, the resulting fabric weave would most likely mimic the qualities of a typical plain weave without the added advantages of a loose weave. Similarly, if a ratio greater than 5:1 is used, the handelablility of the resulting fabric may decrease beyond an advantageous extent, thus negating the favorable construction qualities obtained through the introduction of warp set two.

A preferred ratio of 2:1 is illustrated in FIGS. 1B, 2B, 3B, and 4B. Also in these same figures, the yarns of the plain weave pattern of set two are shown alternating with respect to the same fill yarn. For example, in FIG. 1B, column 3, the yarn of set two is shown in an under-over-under-over pattern with respect to the fill yarn; whereas in FIG. 1B column 6, the yarn of set two is shown in an over-under-over-under pattern with respect to the same fill yarn. The pattern of set two within the same fabric may vary or alternate as desired, as shown in the figures, or the pattern may stay the same throughout the fabric. For example, in a fabric with a 2:1 ratio of set one to set two, the yarns of warp set two (represented in figure columns 3, 6, and so on) may all be over-under-over-under with respect to the same fill yarn. Or, the yarns of warp set two may vary, whereby some are over-under and others are under-over with respect to the same fill yarn.

FIG. 1A shows a traditional plain weave with a single set of warp yarn. The pattern is such that each warp and fill yarn pass in an over-under-over-under pattern. FIGS. 1B and 1C show the addition of set two, also in a plain weave, whereby the introduction of set two disrupts the normal pattern of the traditional, single warp plain weave. In this embodiment, the warp sets are present in a 2:1 ratio of warp set one to warp set two.

FIG. 2A shows a traditional 2/2 basket weave with a single set of warp yarn, whereby each warp yarn passes over two fill yarns, then passes under two fill yarns. The longer float of the basket weave results in a looser weave when compared to a plain weave. The longer float is preferred for high performance fabrics, such as fabrics made for life protection; however, the looser construction results in fraying and separation of the yarns when cutting and handling the fabric.

FIGS. 2B and 2C show the addition of set two into a basket weave, also in a 2:1 ratio, whereby set two is weaving in a plain weave pattern. The plain weave of set two disrupts the basket weave pattern of set one and locks the fill yarns in place. In this manner, the fabric may still maintain the enhanced performance characteristics found in a looser weave with a longer float; yet, the fabric has better handleability and will not fray, fall apart, or suffer from distortion during cutting and construction.

FIG. 3A shows a traditional four harness satin weave with a single set of warp yarn. This weave is very loose with a long float, meaning it provides better ballistic protection but is very difficult to handle. FIGS. 3B and 3C show an embodiment of the present invention whereby a set two is introduced in a plain weave pattern, also in a 2:1 ratio of set one to set two.

FIG. 4A shows a traditional 2/2 twill weave with a single set of warp yarn. FIGS. 4B and 4C again show the introduction of a second set of warp yarn in a plain weave pattern that disrupts the two by two twill weave pattern, thus locking the fill yarns and the weave pattern in place.

Warp set one, warp set two, and the fill yarn may consist of the same or different materials, sizes, and numbers of fibers. For example, the fill yarn and warp set one may be made from fibers of a first material such as an aramid, while warp set two may be made from fibers of a second material such as ultra high molecular weight polyethylene (UHMWPE); the resulting fabric being composed of both aramid and UHMWPE fibers. Alternatively, the fill yarn and both sets of warp yarn may all be fibers of a first material; the resulting fabric being composed of all aramid fibers or all UHMWPE, for example.

Preferred fibers include, but are not limited to, high tenacity polymer fibers, such as various aramid fibers, high performance polyethylene fibers, and the like. Due to their remarkably high tensile strength-to-weight ratio, such fibers have many applications such as body armor. Specific high tenacity fibers suitable for the composite material of the present invention include but are not limited to Kevlar®, a para-aramid synthetic fiber; Twaron, another para-aramid fiber with roughly the same chemical structure; terephthaloyl chloride (TCI), an aramid fiber closely related to para-aramids; and ultra high molecular weight polyethylene (UHMWPE) such as commercially known Dyneema® and Spectra®. Other suitable materials include polybenzobisoxazole fibers (PBO), glass, quartz, heat resistant aramid fiber products such as Nomex® and Protera® fabrics, fiberizable inorganic ceramic materials such as silicon carbide, carbon, graphite, mullite, aluminum oxide and piezoelectric ceramic materials. Non-limiting examples of suitable fiberizable organic materials include cotton, cellulose, natural rubber, flax, ramie, hemp, sisal and wool. Non-limiting examples of suitable fiberizable organic polymeric materials include those formed from polyamides (such as nylon and aramids), thermoplastic polyesters (such as polyethylene terephthalate and polybutylene terephthalate), acrylics (such as polyacrylonitriles), polyolefins, polyurethanes and vinyl polymers (such as polyvinyl alcohol).

Warp set one and warp set two may be the same denier, although it is preferred that set two be a smaller denier than set one. In a typical woven fabric, the weave is balanced because the weight of the warp yarn and fill yarn are the same; however, by introducing a second set of warp yarn into the fabric, the weave may become slightly unbalanced due to having more warp yarns than fill yarns. This unbalance could be remedied by adding more fill yarns; however this additional fill yarn may increase in the weight of the fabric. One goal in manufacturing high performance fabrics is to keep the fabric weight as low as possible; therefore, a lower weight fabric is desirable. For this reason, it is preferred to use a smaller denier for the second warp set to minimize any additional weight of the resulting fabric. By using a smaller denier for warp set two, this second set can serve to interlock the fill yarns and stabilize the pattern of set one without adding much additional weight to the final fabric itself.

A preferred practical denier range for warp set one is 400-1500 denier. The denier of warp set two depends on the denier of set one, although a preferred practical denier range for set two is 100-400 denier. The fill yarn denier is typically the same as the denier of warp set one, however it may be a different denier if so desired. The fabric weight depends on the denier of set one and set two and the number of yarns per inch. Additionally, the fabric weight of ounces per square yard is based on warp set one, warp set two, and fill yarn construction; typically, the added fabric weight due to the addition of set two preferably will not increase by 20% of the weight of warp set two.

Warp set one determines the weave pattern of the overall fabric, while warp set two interlocks the weave of the fill yarn with warp set one. For example, if the fill yarn and warp set one are woven in a 2/2 basket weave, but warp set two is woven with the fill yarn as plain weave, the overall pattern of the fabric remains 2/2 basket, with the plain weave of set two interrupting the 2/2 basket weave and interlocking the basket pattern. Warp set two is preferably woven into the fabric as a plain weave, although it may be any other desired weave useful for a particular application. Plain weave is preferred for set two due to the over-under-over-under pattern that results in more interlocking of the fill yarn, and a plain weave can typically be cut without unraveling or loss of construction.

Although specific fibers, combinations of fibers, weave patterns, combinations of weave patterns, and specific denier ranges, etc. are discussed herein, it is to be understood that these examples do not limit the present invention to just the described embodiments. It is noted that any person skilled in the art of high performance fabrics would know what types of fibers, weaves, weights, deniers, etc. may be suitable for a particular product and would be capable of making the appropriate substitutions and combinations thereof.

FIGS. 5A and 5B charts calculated cover factors and tightness factors of various weave patterns using an aramid yarn to construct hypothetical Fabric A and Fabric B. The charts compare these calculated factor for fabrics with and without a warp set two. The tightness factor represents the tightness and entanglement of the yarns of the fabric. The more entangled the yarns, the greater the tightness factor. This entanglement can be illustrated by the amount of "knuckles" or crimping of yarns in the fabric if the fabric were to be unraveled or unwoven. For example, a plain weave typically has a tightness factor greater than a satin weave due to the over-under-over-under pattern of a plain weave. The satin weave is a looser weave with a longer float, so if you were to unravel a satin weave, it will have less crimping in the fibers than an unraveled plain weave. The cover factor indicates the extent to which the area of a fabric is covered by yarns and isn't necessarily related to any particular weave pattern. Rather, the cover factor is related to how closely the yarns are woven or placed together in any given weave pattern. For example, in FIG. 5*b* it can be seen that the cover factor of all four different weaves, without the inclusion of warp set two, is the same value of 0.54 for Fabric A and 0.50 for Fabric B.

These calculated factors shown in FIGS. 5A and 5B are based on the values calculated and listed in the chart for fabric weight (ounces per square yard), warp denier, tex, ends per inch, warp cover (Kw), fill denier, fill tex, fill per inch, and fill cover (Kf). Anyone skilled in the art would know what these values represent, as well as how to calculate them. These values may be calculated as follows:

$$\text{Yarn diameter inch} = 1.86\times10^{3}\times(\text{Tex/Density})^{0.5}$$

$$\text{Aramid density} = 1.44\ \text{g/cm}^{3}$$

Tex=yarn linear density in gm/1000 m

Warp cover ($Kw$)=ends/inch×(1/warp diameter (measured in inches))

Fill cover ($Kf$)=picks/inch×(1/fill diameter (measured in inches))

Fabric cover factor=$Kw+Kf-(Kw\times Kf)$

Fabric tightness factor=cover factor/weave factor

Weave factor for plain weave=0.75

Weave factor for 2/2 twill, 2/2 basket, and 4H satin=0.889

FIG. 5B shows the additional tightness values and fabric cover values that may be achieved by adding warp set two. When looking at FIG. 5B, the values listed under the column "Tightness Factor" or "Fabric Cover Factor" for the rows that include the addition of warp set two, it should be noted that the values do not represent total tightness factor, rather the values represent what may be added to the existing tightness factor of the same fabric without the addition of warp set two. For example, under Fabric A in FIGS. 5A and 5B: If there are 28 ends per inch in a twill weave with only set one, adding set two in a plain weave with a 2:1 ratio adds 14 additional ends per inch (28 ends divided by 2). The denier of warp set two is preferably lower than the denier of warp set one, in this example 200 denier versus 500 denier. Since set two is added in a warp direction only, all of the fill values may remain the same. In this particular example (a twill weave with the addition of set two in a plain weave at a 2:1 ratio), the fabric cover factor may be increased by a value of 0.39; and, the tightness factor may increase by a value of 0.52.

FIG. 6 charts experimental values of fabric tensile strength, fabric stiffness (warp and fill directions), and fabric king stiffness of various weave patterns for actual Fabric A and Fabric B with the addition of set two in a plain weave at a 2:1 ratio of set one to set two. The fabric tensile strength in FIG. 6 is tested (reference to ASTM D-5035), and the fabric stiffness tested (reference to ASTM D-4032 and ASTM D-1388).

The following tables show the results of ballistic testing of a fabric of the present invention. These tests were performed according to the testing specifications for the National Institute of Justice (NIJ) Standard-0101.06. This standard and other detailed technical information can be found in the *NIJ Standard*-0101.06, *Ballistic Resistance of Body Armor* (July 2008) which specifies the minimum performance requirements that equipment must meet to satisfy the requirements of criminal justice agencies and the methods that shall be used to test such performance; this document is herein incorporated by reference in its entirety.

TABLE 1

Average V50
Test specification- NIJ-0101.06, pack size 15 × 15 (inch)

| Fabric Type | Pack (psf) | NIJ Threat Type | Bullet Type | V50 (ft/s) |
|---|---|---|---|---|
| Fabric "A" 2/2 Twill | 0.76 | II | 9 mm | 1594 |
| (Greige) | 0.76 | II | .357 Mag | 1565 |
| | 0.76 | IIIA | .44 Mag | 1459 |
| Fabric "B" 2/2 Twill | 0.76 | II | 9 mm | 1554 |
| (Greige) | 0.76 | II | .357 Mag | 1567 |
| | 0.76 | IIIA | .44 Mag | 1495 |
| Conventional Ballistic Fabric (Greige) | 0.77 | II | 9 mm | 1543 |
| Fabric "A" 2/2 Twill (Water repellant treated) | 0.76 | II | 9 mm | 1511 |
| Conventional Ballistic Fabric (Water repellant treated) | 0.77 | II | 9 mm | 1452 |

Table 1 shows ballistic performance test results from certified test labs. Fabric "A" and fabric "B" are both a 2/2 twill weave of the present invention (comprising a warp set 1 and warp set 2, described herein) tested against a conventional aramid ballistic fabric (comprising only one warp set). Fabric "A" and "B" are a 0.76 psf panel (corner stitched), and the conventional fabric is a 0.77 psf panel. Tests are performed according to the NIJ Standard-0101.06 for level type II and IIIA, and the V50 performance in both greige and water repellant treated fabric is compared. Fabric A of the present invention shows an improvement in V50 values due to the structure of Fabric A, which consists of warp set 1 and warp set 2, as described herein. This inclusion of warp set 2 not only increases the stability and handleablility of Fabric A, but also reduces the number of fabric plies needed in a pack as compared to conventional ballistic fabric. Typically, water repellent treatment reduces the ballistic performance; however, the V50 shown for water repellant-treated fabric "A" remains superior to that of the conventional fabric.

TABLE 2

Ballistic performance of hybrid design
Test specification NIJ-0101.06, pack size 15 × 15 (inch)
Threat level type IIIA, caliber tested: .44 Magnum

| | Shot number | | | | | |
|---|---|---|---|---|---|---|
| | 1 | 2 | 3 | 4 (30° angle) | 5 (45° angle) | 6 |
| Hybrid Design: Fabric "A" 2/2 Twill (40% by wt) and UD-1 (60% by wt) Pack areal weight (psf) 1.26 | | | | | | |
| Velocity (ft/s) | 1404 | 1421 | 1419 | 1437 | 1426 | 1416 |
| BFS (mm) | 37.43 | 37.10 | 37.46 | 29.29 | 34.03 | 37.81 |
| Hybrid Design: Fabric "A" 2/2 Twill (40% by wt) and UD-2 (60% by wt) Pack areal weight (psf) 1.25 | | | | | | |
| Velocity (ft/s) | 1417 | 1441 | 1425 | 1414 | 1437 | 1411 |
| BFS (mm) | 36.17 | 36.76 | 38.57 | 33.92 | 30.16 | 34.76 |

Table 2 shows hybrid pack ballistic performance as tested in certified test labs. Ballistic testing of these packages is carried out according to NIJ Standard-0101.06, V0 level IIIA protocol, and the backface signature (BFS) is measured. The maximum allowable BFS for law enforcement applications is 44 mm. Fabric "A" is a 2/2 twill of the present invention (comprising a warp set 1 and warp set 2, as described herein) tested in a hybrid design with two different unidirectional fiber-based composite laminate products (UD-1 and UD-2) at areal density of 1.26 psf and 1.248 psf respectively. In this hybrid design, Fabric "A" is 40% fabric weight of total pack weight, and the UD products consist of 60% fabric weight of the total pack weight. Fabric "A" shows a good back face signature (BFS) due to observed high engagement of bullets with fabric. Results are shown in table 2, with 44 mm being the maximum allowable BFS. The projectile stopped within the fabric plies, meaning the fabric successfully "engaged" the bullet. This testing demonstrates the fabric performance for law enforcement applications.

The present invention as described hereinafter may be embodied in many different forms and should not be construed as limited to the embodiments set forth. Rather, these embodiments are provided so that this disclosure will be operative, enabling, and complete. Accordingly, the particular arrangements disclosed are meant to be illustrative only and not limiting as to the scope of the invention. One skilled in the art is capable of knowing, for example, which weave patterns, yarn materials, and deniers are preferred for specific high performance fabric uses, composites, etc., as well as what types of substitutions may be appropriate or suitable. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

What is claimed is:

1. A woven fabric comprising:

a fill yarn set, a first warp yarn set, and a second warp yarn set woven into a single layer;

wherein said first warp yarn set and said fill yarn set are woven into a twill weave pattern; and said second warp yarn set interposed within said first warp yarn set, said second warp yarn set interrupting said twill weave pattern to lock said fill yarns into position to prevent fraying when said woven fabric is cut.

2. The woven fabric according to claim 1, wherein yarns of the first warp yarn set and yarns of the second warp yarn set alternate in a ratio.

3. The woven fabric according to claim 2, wherein said ratio is selected from the range of 2:1 to 5:1.

4. The woven fabric according to claim 2, wherein said ratio is selected from the range of 2:1 to 3:1.

5. The woven fabric according to claim 1, wherein said fill yarn set, said first warp yarn set, and said second warp yarn set include fibers selected from a group consisting of aramids, copolymer aramids, ultra high molecular weight polyethylene, glass, quartz, and carbon.

6. The woven fabric according to claim 5, wherein said twill weave pattern is a 2/2 twill weave pattern.

7. The woven fabric according to claim 1, wherein said second warp yarn set is woven into a plain weave pattern, so that said second warp yarns alternate in a repeating over and under pattern with respect to said fill yarns.

8. The woven fabric according to claim 1, wherein the yarns of the first warp yarn set have a first denier and the yarns of the second warp yarn set have a second denier, the first and second deniers being different from one another.

9. The woven fabric according to claim 8, wherein the first denier is in the range of 100-2000, and the second denier is in the range of 50-500.

10. A woven fabric comprising:

a fill yarn set, a first warp yarn set, and a second warp yarn set woven into a single layer;

wherein said first warp yarn set and said fill yarn set are woven into a basket weave pattern; and said second warp yarn set interposed within said first warp yarn set, said second warp yarn set interrupting said basket weave pattern to lock said fill yarns into position to prevent fraying when said woven fabric is cut.

11. The woven fabric according to claim 10, wherein yarns of the first warp yarn set and yarns of the second warp yarn set alternate in a ratio.

12. The woven fabric according to claim 10, wherein said ratio is selected from the range of 2:1 to 5:1.

13. The woven fabric according to claim 12, wherein said ratio is selected from the range of 2:1 to 3:1.

14. The woven fabric according to claim 10, wherein said fill yarn set, said first warp yarn set, and said second warp yarn set include fibers selected from a group consisting of aramids, copolymer aramids, ultra high molecular weight polyethylene, glass, quartz, and carbon.

15. The woven fabric according to claim 10, wherein said second warp yarn set is woven into a plain weave pattern, so that said second warp yarns alternate in a repeating over and under pattern with respect to said fill yarns.

16. The woven fabric according to claim 10, wherein the yarns of the first warp yarn set have a first denier and the yarns of the second warp yarn set have a second denier, the first and second deniers being different from one another.

17. The woven fabric according to claim 16, wherein the first denier is in the range of 100-2000, and the second denier is in the range of 50-500.

18. A woven fabric comprising:

a fill yarn set, a first warp yarn set, and a second warp yarn set woven into a single layer;

wherein said first warp yarn set and said fill yarn set are woven into a satin weave pattern, and wherein the yarns of the first warp yarn set have a denier in the range of 100-2000, and the yarns of the second warp yarn set have a denier in the range of 50-500;

said second warp yarn set interposed within said first warp yarn set, said second warp yarn set interrupting said satin weave pattern to lock said fill yarns into position to prevent fraying when said woven fabric is cut; and wherein said fill yarn set, said first warp yarn set, and said second warp yarn set include fibers selected from a group consisting of aramids, copolymer aramids, ultra high molecular weight polyethylene, glass, quartz, and carbon.

19. The woven fabric according to claim 18, wherein said second warp yarn set is woven into a plain weave pattern, so that said second warp yarns alternate in a repeating over and under pattern with respect to said fill yarns.

20. The woven fabric according to claim 18, wherein yarns of the first warp yarn set and yarns of the second warp yarn set alternate in a ratio selected from the range of 2:1 to 5:1.

* * * * *